US011446679B2

(12) United States Patent
Koenig et al.

(10) Patent No.: US 11,446,679 B2
(45) Date of Patent: Sep. 20, 2022

(54) OUTLET DEVICE OF A SEPARATOR

(71) Applicant: Flottweg SE, Vilsbiburg (DE)

(72) Inventors: Thomas Koenig, Vilsbiburg (DE); Benno Vielhuber, Vilsbiburg (DE); Stefan Bichlmeier, Geisenhausen (DE); Frank Giegler, Vilsbiburg (DE); Ronny Jaensch, Woerth (DE)

(73) Assignee: Flottweg SE, Vilsbiburg (DE)

( * ) Notice: Subject to any disclaimer, the term of this patent is extended or adjusted under 35 U.S.C. 154(b) by 386 days.

(21) Appl. No.: 16/486,183

(22) PCT Filed: Feb. 14, 2018

(86) PCT No.: PCT/DE2018/100130

§ 371 (c)(1),
(2) Date: Aug. 15, 2019

(87) PCT Pub. No.: WO2018/149452

PCT Pub. Date: Aug. 23, 2018

(65) Prior Publication Data

US 2020/0230616 A1 Jul. 23, 2020

(30) Foreign Application Priority Data

Feb. 15, 2017 (DE) ..... 10 2017 103 065.4

(51) Int. Cl.
*B04B 11/08* (2006.01)
*B04B 1/08* (2006.01)
*B04B 11/02* (2006.01)

(52) U.S. Cl.
CPC ..... *B04B 11/082* (2013.01); *B04B 1/08* (2013.01); *B04B 11/02* (2013.01)

(58) Field of Classification Search
CPC ..... B04B 11/082; B04B 1/08; B04B 11/02
USPC ..... 494/41, 38
See application file for complete search history.

(56) References Cited

U.S. PATENT DOCUMENTS 3,930,609 A * 1/1976 Nelson ..... B04B 1/14 494/1
4,210,275 A 7/1980 Zettier
4,983,158 A * 1/1991 Headley ..... A61M 39/28 494/38
5,167,609 A 12/1992 Graw et al.
(Continued)

FOREIGN PATENT DOCUMENTS

DE 1 078 506 3/1960
DE 25 34 788 2/1976
(Continued)

OTHER PUBLICATIONS

German Office Action dated Oct. 11, 2017.
International Search Report dated May 14, 2018.

*Primary Examiner* — Walter D. Griffin
*Assistant Examiner* — Shuyi S. Liu
(74) *Attorney, Agent, or Firm* — Gerald E. Hespos; Michael J. Porco

(57) ABSTRACT

An outlet device (24) of a separator (10) has an outlet channel (38) for discharging a liquid phase from a rotating drum of the separator (10). The outlet channel (38) extends along a rotational axis (16) in a fixed tube device (42) of the separator (10). A cap (74) is connected fixedly to the tube device (42), surrounds the tube device (42), and covers the drum in the radial direction.

9 Claims, 2 Drawing Sheets

(56) References Cited

U.S. PATENT DOCUMENTS

| | | | | |
|---|---|---|---|---|
| 2006/0286206 | A1* | 12/2006 | Spiekermeier | B04B 1/08<br>426/11 |
| 2017/0333915 | A1* | 11/2017 | Mackel | B04B 7/08 |

FOREIGN PATENT DOCUMENTS

| | | |
|---|---|---|
| DE | 27 37 463 | 2/1979 |
| DE | 40 14 552 | 7/1991 |
| DE | 103 35 191 | 5/2005 |
| WO | 94/08723 | 4/1994 |
| WO | 2016/091617 | 6/2016 |

* cited by examiner

OUTLET DEVICE OF A SEPARATOR

BACKGROUND

Field of the Invention

The invention relates to an outlet device of a separator, the outlet device comprising an outlet channel for discharging a liquid phase from a rotating drum of the separator, wherein the outlet channel extends along a rotational axis in a fixed tube device of the separator. The invention furthermore relates to the use of such an outlet device for discharging a liquid phase at a separator.

Related Art

Separators are centrifuges serving the purpose of separating phase mixtures by means of centrifugal force in a drum rotating about a rotational axis. Thereby, the phase mixture is separated into at least one light phase and at least one heavy phase. Such centrifuges are referred to as separators and feature a substantially vertical rotational axis for the rotating drum. A separator of this kind is known from WO 94/08723 A1, for example.

On the rotating drum of such conventional separators, an outlet device is situated in the upper part, by means of which the liquid phase separated from the phase mixture can be conducted upwards out from the drum.

For discharging the liquid phase, the outlet device comprises an outlet channel usually extending along the rotational axis of the drum in a fixed tube device of the separator. Radially outside and axially below the fixed tube device the rotating drum is arranged, within which the phase mixture is to be segregated or separated.

One problem of such outlet devices is that phase mixtures and in particular their separated liquid phases might get in contact with ambient air there. Especially in the case of phase mixtures and liquid phases, which react with oxygen contained in ambient air, such a contact must be prevented. Moreover, it may be necessary to protect phase mixtures and liquid phases from undesired degassing into the environment. In particular when beer is separated, such a gas exchange with the environment must be prevented.

There exist various shut-off concepts for solving such a problem. Slide ring seals are employed in fully hermetical separators, for example. Such slide ring seals are exposed to heavy friction during the rotating operation of the drum. High energetic friction losses and strong mechanical wear are the consequence.

The invention is based on the task of creating an outlet device of a separator, by means of which a contact of the liquid phase with ambient air can be prevented reliably in particular throughout the entire separation process. By means of such an outlet device, the associated separator should moreover be able to be operated at lower energy requirement as compared to known separators.

SUMMARY

According to the invention, an outlet device of a separator comprises an outlet channel for discharging a liquid phase from a rotating drum of the separator, in which the outlet channel extends along a rotational axis of the drum in a fixed tube device of the separator. A cap is is connected fixedly to the tube device, surrounds the tube device and covers the drum in the radial direction.

A cap, in the present case, is understood to be a component that surrounds the tube device and is hollow in its interior. The component of that kind extends in the radial and axial directions such that a cap-like or hood-like shape is formed by its outer walls. The outer walls may in this case be shaped to be curved, flat and angular, or flat and oblique. An outer wall of the cap of a flat and oblique shape has turned out to be particularly preferred.

Such an inventive cap creates a covering element that is connected fixedly to the tube device. Such a covering element that is connected fixedly to the tube device and is not movable with respect to the tube device can be arranged particularly stably and particularly tightly on the tube device.

Moreover, the tube device is surrounded by the inventive cap. In this case, the cap encompasses the tube device over the entire circumference. Such a surrounding, in particular encompassing, enables the drum to be covered in a gapless and thus particularly tight manner by means of the cap.

Furthermore, the cap of such a design covers the drum in the radial direction according to the invention. Such an extension of the cap creates a hollow space that is above the drum and that is formed by the interior of the cap. Owing to the fixed connection to the tube device and surrounding the tube device, the hollow space is particularly well sealed even in a gas-tight manner. Sealed in such a way, the hollow space may serve as a buffer space designed to be gas-tight in the direction of the tube device. In such a buffer space, a gas may be received and may exert the function of a sealing gas. For this purpose, the sealing gas according to the inventive configuration of the cap covers the rotating drum in the radial direction and thus in particular also the liquid phase in the outlet device. Covered in such a manner, the sealing gas received within the inventive cap prevents the contact of the liquid phase with ambient air. As a sealing gas, preferably a gas such as carbon dioxide is used. Carbon dioxide is of higher density than ambient air and already pushes against the rotating drum, and thus in particular also pushes against the liquid phase by its very nature.

Moreover, it has been shown that swirls or turbulences in the sealing gas may be avoided very effectively by means of the inventive cap. Avoiding such swirls allows for energy losses to be saved during operation, which otherwise would occur due to a correspondingly high friction. Such friction losses conventionally mainly occur when the sealing gas is used within a drum housing surrounding the rotating drum. By the inventive cap, such use of sealing gas within the drum housing may thus be avoided in an energy and raw material saving manner.

By the inventive cap, an outlet device consequently is created which enables a particularly tight and almost friction-free covering of the rotating drum, and thus in particular of the liquid phase. The contact of the liquid phase and also of the phase mixture with ambient air may be avoided reliably, and operating energy may be saved in addition.

In an inventively advantageous manner, the cap covers the drum in the radial direction and in addition also in the axial direction. With such an advantageous configuration, the drum is not only surrounded by the cap in the radial direction but in addition also beyond its circumference in the axial direction. A cap cavity created therewith in the interior of the cap thus encompasses also the drum around its upper area. A gas received within such a cap cavity may flow around the drum there also axially in particular as a sealing gas. The drum and thus the liquid phase that may flow around may be blocked even better against ambient air. In particular during rotation of the drum, the gas in the cap cavity may be kept securely over and at the drum due to the gas axially covering the drum. Drifting of the gas may be avoided so that the gas will not escape into a space surrounding the drum.

Due to the cap extending radially and axially across the drum, the gas may be kept and guided reliably within the cap cavity upward and radially outward. Thus, gas of lower density than ambient air may also be used. Depending on the need for its chemical and physical properties, exactly the suitable gas may thus be used as the sealing gas independent of its density.

Moreover, according to the invention, a drum ring being L-shaped in cross section and fixedly connected to the drum advantageously is arranged in the interior of the cap. Arranged in such a way, the drum ring rotates together with the drum when the drum is rotating, while the cap is held statically on the fixed tube device. Inside the cap, the drum ring thus rotates with respect to the cap at the same rotational speed as the rotating drum. It has been shown that a laminar flow is formed on the drum ring due to its configuration being L-shaped in cross section, and this flow neither stalls nor swirls. Such a laminar flow inside the cap is only of little resistance and saves energy during the rotation of the drum.

Preferably, a configuration of the drum ring being L-shaped in cross section is such that the L-shaped drum ring features a smaller diameter at its upper ring edge than at its lower ring edge. The upper ring edge may be arranged radially relatively far inside. Configured such, the upper ring edge with its inner edge may serve as an overflow weir for a sealing fluid to be received within the drum in case of requirement, and this overflow weir reaches particularly far inward. Such a sealing fluid is intended to block in particular the liquid phase within the drum from contact with ambient air. The farther radially inside the overflow weir is, the farther radially inward and thus all the more reliably the liquid phase may be blocked.

Moreover, according to the invention, inside of the drum ring being L-shaped in cross section, a web ring fixedly connected to the tube device and extending radially to the outside is advantageously arranged. Thus, the web ring is held statically on the tube device just like the inventive cap, while the drum ring rotates together with the drum during operation of the separator. Moreover, the web ring, similar to a web, is relatively flat in cross section. Such a configuration enables a narrow clearance between the web ring and the drum ring being L-shaped in cross section similar to a ring disc. In this narrow clearance, a laminar flow forms during rotation of the drum enabling a particularly low-friction rotation. Moreover, the clearance of this type may serve as a kind of labyrinth seal for a sealing fluid to be received within the drum if necessary. By such a labyrinth seal, the sealing fluid may be sealed in a particularly low-wear and energy saving manner with respect to the interior of the cap.

In addition, according to the invention, a gripper advantageously is supported on the inside end area of the tube device. Such a gripper is a disc-shaped discharge device in which a radially directed discharge channel is situated. The discharge channel discharges the material to be discharged, usually the liquid phase, radially inward from the radially outer area of the drum and into the outlet channel. In this case, it is necessary for the material to be subjected to a certain pressure so that it continues to flow through the outlet channel. Such a pressure may only be generated inside the rotating drum by the centrifugal force prevailing therein. It is therefore necessary for the gripper with its at least one discharge channel to extend and be immersed dip sufficiently deep into the separated phase to be discharged.

When the material is discharged this way, the material does not get into contact with ambient air during the discharge. By such a material discharge, the blocking situation with respect to ambient air is improved further, in addition to the described blocking option due to the cap according to the invention.

Furthermore, according to the invention, the gripper advantageously is surrounded by a gripper chamber that is surrounded in each case by one radial and axial gripper chamber wall belonging to the drum, of which only the radial gripper chamber wall is provided with a ribbing. Designed such, the gripper stands still while the gripper chamber with its gripper chamber walls moves around the gripper when the drum is rotating.

Gripper chambers of known separators feature ribbings on their inner walls both on the radial and axial gripper chamber walls. Such ribbings serve to set and to keep the material in motion in the gripper chamber, that is normally the separated liquid phase.

In contrast, in the gripper chamber according to the invention, the axial gripper chamber wall is flat in its interior, and only the radial gripper chamber wall is provided with a ribbing in its interior. Surprisingly, it has been shown that such a ribbing is sufficient to set and keep the liquid phase within the gripper chamber in motion with the rotation of the drum. In addition, considerably less swirls occur in the liquid phase than in known gripper chambers, thereby enabling a better material removal at lower friction losses. Thus, a particularly energy-saving outlet device is created in combination with the inventive cap.

Furthermore, according to the invention, a blocking disc fixedly connected to the tube device advantageously is provided axially between the cap and the gripper. The blocking disc is surrounded by a blocking chamber delimited by blocking chamber walls belonging to the drum. Thus, the blocking chamber together with its blocking chamber walls rotates when the drum is rotating, while the blocking disc stands still statically. A blocking fluid may be received within such a blocking chamber. The blocking fluid rotates together with the blocking chamber when the drum is rotating, and rests in this case radially outside against the associated blocking chamber wall at a determined blocking fluid pool depth. The blocking disc dips into such a rotating blocking fluid pool. Dipping in this way, the blocking disc prevents a contact between the interior of the cap and the gripper chamber associated to the gripper. As a result, the material inside the gripper chamber, in particular the separated liquid phase, is blocked from a medium located inside the cap. The medium located inside the cap may in this case be ambient air, which then is blocked from the liquid phase located within the gripper chamber by means of the blocking fluid and the blocking disc. When certain operating conditions require it, the cap as well, as already described, may be filled with a gas serving as the blocking gas. Depending on the operating situation, an optimum blocking situation of the separated liquid phase with respect to ambient air may thus always be set.

On the other hand, it is known to provide a blocking chamber with a blocking disc in separators. However, these conventional blocking situations only work well at higher and maximum flow rates of the respective machine size. The full and reasonable range for the process may not be utilized completely in this case, since at lower flow rates, an increased oxygen uptake from the environment by the separated liquid phase can be seen. At lower flow rates, the drum is no longer filled completely. Pressure conditions prevailing therein are different and may even be reverse to the pressure conditions when the drum is filled completely. Blocking fluid from the blocking chamber may be sucked into the drum, whereby the blocking disc does no longer seal sufficiently. In order to prevent such a suction, very high discharge pressures of more than 6 bar must be worked with, and this means that the liquid phase is pushed upward into the blocking chamber. Thereby, the drum party overflows. A part of the liquid phase gets lost as a product, and the energy consumption rises.

Only with the solution according to the invention, a blocking gas may be introduced, if required, into the interior of the cap and from there into the blocking chamber, in particular from above. This blocking gas in the blocking chamber may prevent the liquid phase from escaping from the gripper chamber into the blocking chamber. If required, a suction may also be applied to the interior of the cap so as to prevent blocking fluid to be sucked from the blocking chamber into the drum. According to the invention, it has been shown that variable product flow rates of the entire range are realized without a significant oxygen uptake. For this purpose, variable discharge pressures of in particular 2 to 6.5 bar may be combined. Thus, a contact with ambient air may be avoided throughout the entire separation process at most different pressure conditions in the separator.

In an advantageous manner according to the invention, all blocking chamber walls of the blocking chamber moreover are without ribbing at their associated inner walls. Thus, all of the blocking chamber walls are flat or smooth. Due to such walls, a blocking fluid present in the blocking chamber is only subjected to a few turbulences when the blocking chamber is rotating. Further swirl losses may be prevented, and additional operating energy may be saved.

Furthermore, according to the invention, the blocking disc advantageously is configured to have a constant disc thickness in the radial direction. As far as manufacturing technology is concerned, such a blocking disc is easier to realize and more stable during operation than conventional blocking discs which are configured to be relatively narrow and tapering toward the outside. By means of the constant disc thickness, a regular spacing from the components surrounding the blocking disc, in particular the blocking chamber walls, may moreover be realized. Such a regular spacing enables a mostly only laminar flow in the rotating blocking fluid at the blocking disc when the blocking chamber is rotating. Otherwise occurring and energy consuming friction losses in the blocking fluid are reduced.

The disc thickness in one embodiment is larger than in known blocking discs, and the blocking disc may larger in its diameter than known blocking discs. This allows less spacing from the components surrounding the inventive blocking disc to be realized than is the case with known blocking chambers. Surprisingly, it has been shown that a smaller volume of the inventive blocking chamber at correspondingly less swirls in the blocking fluid which can be achieved therewith, enables a far better blocking situation as compared to known blocking chambers. Moreover, this improved blocking situation provides for an energy saving of up to 20 percent of the operating energy.

According to the invention, an inlet device in one embodiment is formed in the interior of the outlet device for admitting a phase mixture to the drum of the separator. By means of an inlet device arranged in this way, the phase mixture may be introduced into the drum without contact to ambient air and oxygen contained therein. An inlet channel belonging to the inlet device is provided for this purpose inside the fixed tube device, said inlet channel usually being configured in the form of a feed tube extending concentrically along the rotational axis. From the feed tube, the phase mixture reaches the drum centrally and is separated there according to the density ratios of the phase components when the drum is rotating. The denser, often solid phase is pushed radially outside against the drum wall, and the less dense, usually liquid phase accumulates radially inward as a liquid ring. Thus, a particularly regular weight distribution is enabled by the inventively advantageous inlet device located inside the outlet device, which saves in addition swirl losses and operating energy.

Furthermore, the invention relates to the use of such an outlet device for discharging a liquid phase from a separator.

DETAILED DESCRIPTION

Figure 1:
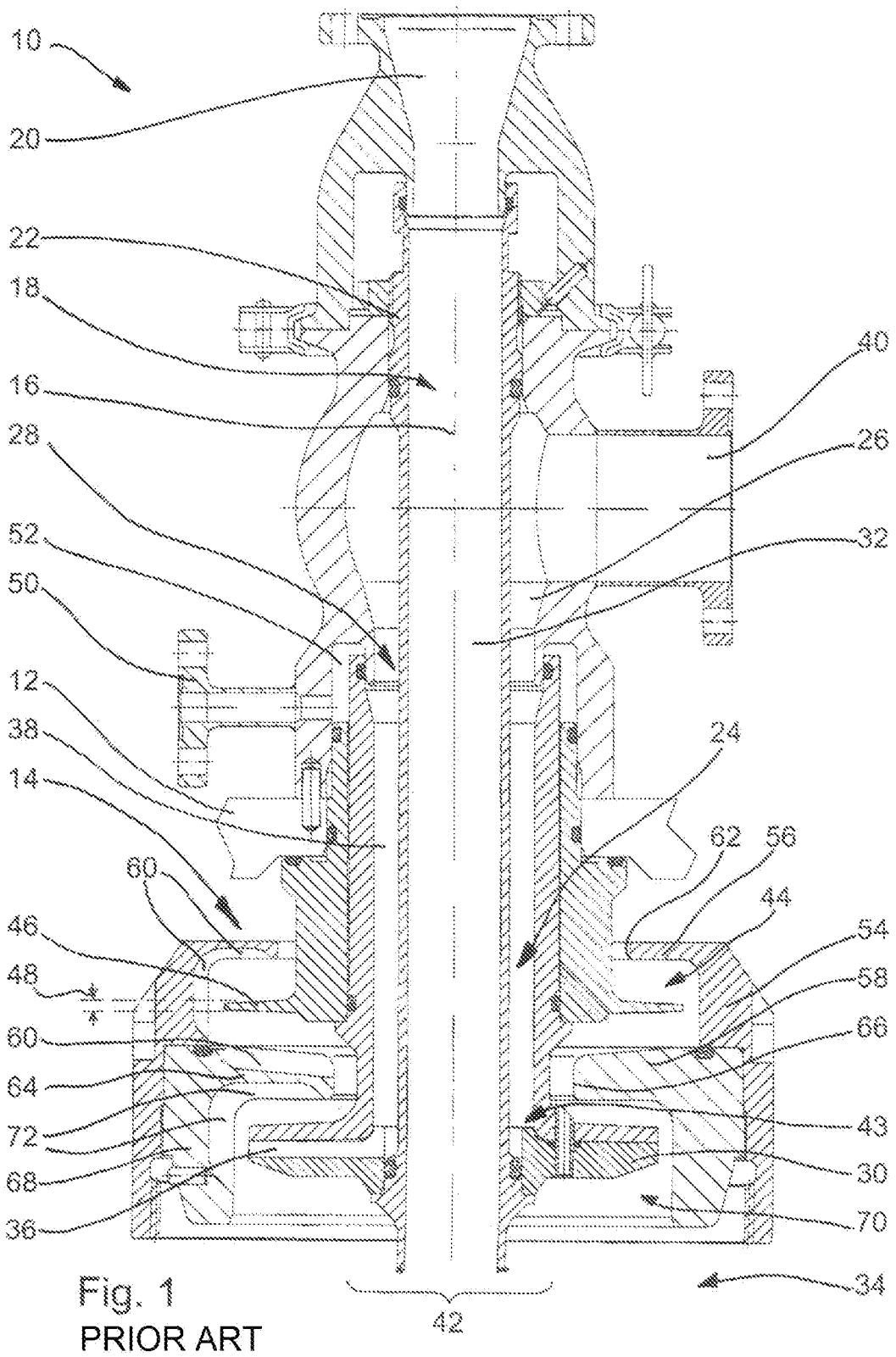
Fig. 1 PRIOR ART
FIG. 1 is a partial longitudinal section of an outlet device of a separator according to the state of the art.

FIG. 1 illustrates, partially indicated, the fixed drum housing 12 of a separator 10 and a blocking device 14 arranged therein. With respect to the operating position, the blocking device 14 forms the upper end of a drum not shown in more detail. During the operation of the separator 10, the drum rotates as a rotor around a rotational axis 16 at a high speed.

An inlet device 18 protrudes upward out from the drum housing 12, at the axially upper end of which inlet device 18, an inlet nozzle 20 is situated for introducing a good, product or phase mixture to be clarified.

The inlet nozzle 20 leads into an inlet tube 22 extending coaxially to the rotational axis 16. Radially outside around the inlet tube 22, an outlet tube 26 belonging to an outlet device 24 is arranged, so that the inlet device 18 is arranged inside the outlet device 24. Thereby, the inlet tube 22 and the outlet tube 26 extend coaxially in a common channel portion 28. The common channel portion 25 ends in the drum axially inside at a fixed gripper 30.

In the inlet tube 22, a circular cylindrical inlet channel 32 is situated, which is guided centrally through the gripper 30 and leads into the interior 34 of the drum.

In the gripper 30, three radially directed gripper channels or discharge channels 36 are formed leading from radially outside to radially inside and ending at a hollow cylindrical outlet channel 38. The discharge channels 36 serve to discharge clarified liquid phase from the interior 34 of the drum.

The outlet channel 38 is situated between the inlet tube 22 and the outlet tube 26. The outlet channel 38 leads in this case axially throughout the common channel portion 28 to an outlet nozzle 40, where the discharged liquid phase is led out from the outlet device 24.

The outlet channel 38 arranged in this way coaxially outside around the inlet channel 32 thus extends along the rotational axis 16 within a fixed tube device 42 comprising the inlet tube 22 and the outlet tube 26. The common channel portion 28 of the inlet tube 22 and the outlet tube 26 thereby ends axially inside the drum at the fixed gripper 30, which is therewith supported on the inside end area 43 of the tube device 42.

The blocking device 14 is arranged axially above the gripper 30 an comprises a blocking chamber 44, in which a radially oriented circular blocking disc 46 is situated. Being slightly conical in its disc thickness, the blocking disc 46 extends radially to the outside, which results in a relative thin mean disc thickness 48. Furthermore, a blocking fluid nozzle 50 is provided through which a blocking fluid may be introduced into the blocking chamber 44 in a blocking fluid channel 52. The blocking fluid is used to prevent oxygen from ambient air to be able to reach the interior 34 of the drum and the product there from outside.

Usually, degassed water (low in oxygen) serves as the blocking fluid. Such a hydro-hermetical blocking allows the interior 34 of the drum to be sealed with respect to its environment without mechanical wear.

The blocking disc 46 surrounds the fixed tube device 42 coaxially and fixedly as a blocking ring. Therewith, the blocking disc 46 is situated inside the blocking chamber 44 which is delimited radially inside by the fixed tube device 42. Furthermore, the blocking chamber 44 is delimited radially outside by an axial blocking chamber wall 54, axially on the top by an upper radial blocking chamber wall 56 and axially at the bottom by a lower radial blocking chamber wall 58. All of the blocking chamber walls 54, 56, and 58 rotate as a part of the rotating drum together with this drum around the rotational axis 16.

In this case, the axial blocking chamber wall 54 features a plurality of axial grooves, and all of the radial blocking chamber walls 56 and 58 feature a plurality of grooves as ribbing 60. Such ribbings 60 support rotating of a blocking fluid introduced into the blocking chamber 44 with the blocking chamber walls 54, 56 and 58 rotating along with the drum.

Both radial blocking chamber walls 56 and 58 are arranged radially inside to be spaced from the fixed tube device 42. Thereby, the upper radial blocking chamber wall 56, as compared to the lower radial blocking chamber wall 58, has a smaller inner diameter, by which a blocking chamber overflow edge 62 is defined. The blocking fluid in the blocking chamber 44 should not rise beyond this blocking chamber overflow edge 62 in the direction of the rotational axis 16. Otherwise, the blocking fluid would exit from the blocking chamber 44. Thus, the blocking chamber overflow edge 62 defines a maximum possible pool depth of a blocking fluid pool.

In the present case, the lower radial blocking chamber wall 58 is at the same time an upper radial gripper chamber wall 64 which defines a drum overflow edge 66 by its inner diameter. The product situated in the interior 34 of the drum is not allowed to rise in the radial direction to the rotational axis 16 above the drum overflow edge 66. Otherwise, the product would exit through the blocking chamber 44 to the outside, what would lead to product losses. Thus, a maximum possible pool depth of the separator 10 is defined by means of this drum overflow edge 66.

An axial gripper chamber wall 68 joins the radial gripper chamber wall 64 radially outside, which together belong to a gripper chamber 70 surrounding the gripper 30 and open downward toward the interior 34 of the drum. In this case, the radial gripper chamber wall 64 features radial grooves and the axial gripper chamber wall 68 features axial grooves as ribbings 72. These ribbings 72 support a rotational movement of the liquid phase in the gripper chamber 70 when the drum is rotating. Thereby, the gripper chamber walls 64 and 68 likewise rotate around the rotational axis 16 as a part of the rotating drum.

Figure 2:
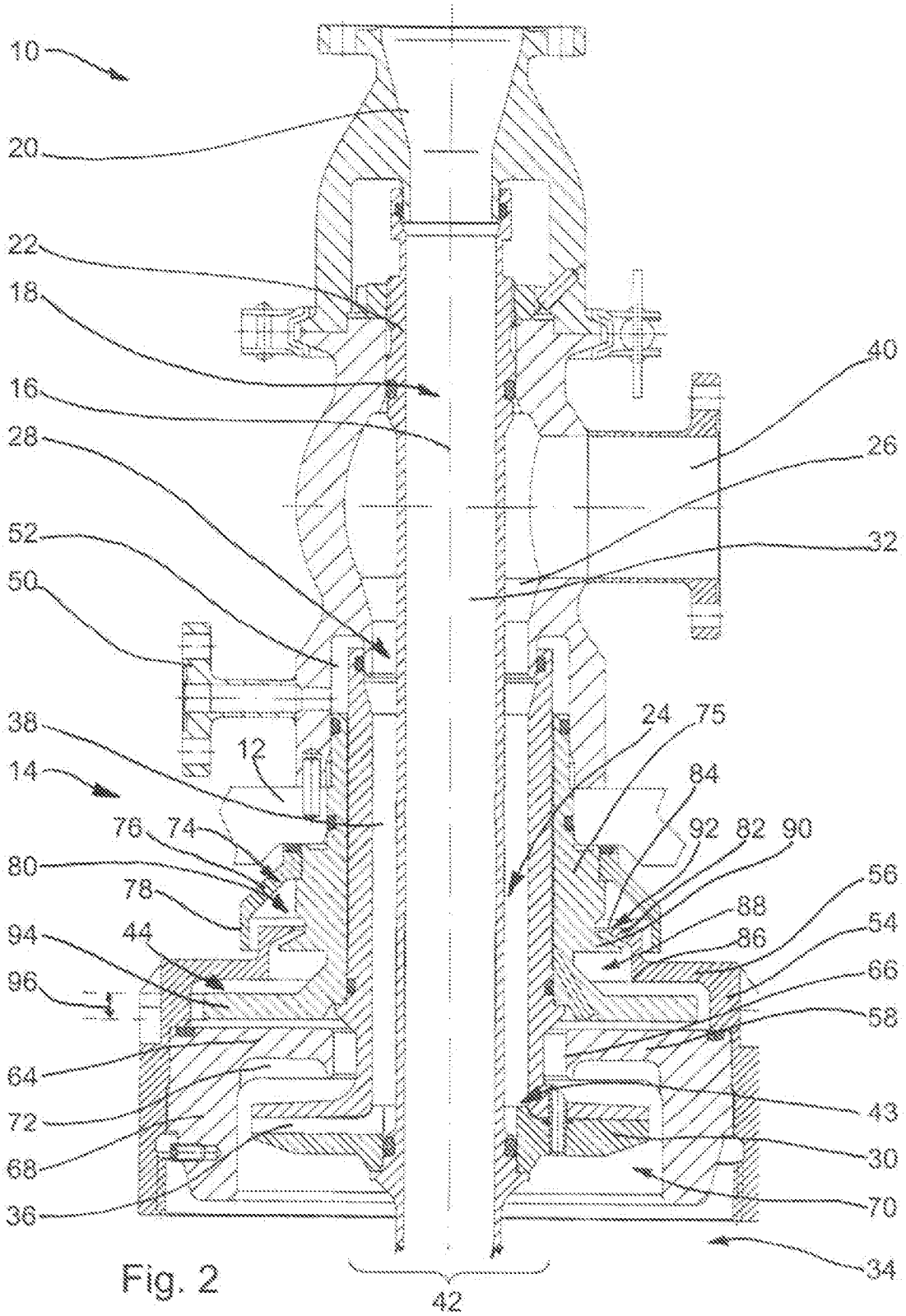
FIG. 2 is a section according to FIG. 1 of an outlet device of a separator according to the invention.

In FIG. 2, a separator 10 according to the invention is illustrated, in which the blocking device 14 with its blocking chamber 44 represents the upper end in the operation position of a drum not represented in greater detail. In a manner similar to the separator 10 according to FIG. 1, a gripper chamber 70 surrounding the gripper 30 is arranged axially below the blocking chamber 44.

As essentially distinguished from FIG. 1, a cap 74 surrounding the fixed tube device 42 is situated axially above the blocking chamber 44 with its upper radial blocking chamber wall 56. The cap 74 is fixedly connected to a fastening tube 75 that is configured to be stepped radially outside, which fixedly and coaxially surrounds the outlet tube 26 and belongs to the tube device 42.

The cap 74 comprises a flat outer wall section 76 extending obliquely downward and radially to the outside, which is connected to the fastening tube 75 radially inside. Following this oblique outer wall section 76, a hollow cylindrical outer wall section 78 of the cap 74 extending coaxially to the rotational axis 16 is situated radially outside. Thus, an interior or a cavity 80 of the cap 74 is formed such that the oblique outer wall section 76 covers the drum with its upper radial blocking chamber wall 56 in the radial direction. Further, the interior 80 of the cap 74 or the cap cavity covers the drum at least with a lower part of the hollow cylindrical outer wall section 78 in the axial direction.

Shaped this way, a blocking gas such as, for example, carbon dioxide, may be introduced into the interior 80 of the cap 74 as necessary, which then will separate the drum in its upper area radially and axially from ambient air as a gas separating layer.

Moreover, a drum ring 82, L-shaped in its cross section and integrally formed with the upper radial blocking chamber wall 56, is arranged in the interior 80 of the cap 74. The drum ring 82 is thus fixedly connected to the drum and rotates around the rotational axis 16 during rotation of the drum.

The drum ring 82 has an upper ring edge 84 and a lower ring edge 86, wherein the upper ring edge 84 features a smaller diameter than the lower ring edge 86. Thus, the upper ring edge 84 of this kind serves as an overflow edge or overflow weir for the blocking fluid received within the blocking chamber 44. Moreover, the upper ring edge 84 is arranged to be radially further inside than the blocking chamber overflow edge 62 according to FIG. 1.

Within a thus formed L-shaped cavity or interior 88 of the drum ring 82, a web ring 90 fixedly connected to the tube device 42 is arranged. The web ring 90 is configured integrally with the fastening tube 75 in a particularly stable manner and runs from the fastening tube 75 radially to the outside in parallel along an upper ring area 92 of the L-shaped drum ring 82. This upper ring area 92 extends from the upper ring edge 84 radially to the outside and constitutes a relatively small spacing from the web ring 90 so that a very narrow clearance is formed in this area. Thus formed, a kind of labyrinth is formed by the web ring 90 and the upper ring area 92 of the L-shaped drum ring 82, which labyrinth may act sealingly to a certain extent.

The labyrinth of this kind is surrounded by the interior 80 of the cap 74. Blocking gas introduced therein thus also surrounds the labyrinth, whereby a blocking gas pressure against the labyrinth may be built up. In the region of the labyrinth, the blocking gas pressure will then press against a blocking fluid pressure which builds up by means of the blocking fluid present in the blocking chamber 44. If necessary, these pressure conditions on the labyrinth may be varied and set so that different rates of flow can be realized in the drum without product loss.

For introducing blocking fluid or blocking gas, a blocking gas supply in the form of a fluid line and advantageously coming from outside is formed through the drum housing 12 and/or through the fastening tube 75 into the interior 80 of the cap 74 and/or into the interior 88 of the drum ring 82.

Further, there is a blocking disc 94 within the blocking chamber 44 featuring a constant disc thickness 96 in the radial direction. This disc thickness 96 is substantially greater than the mean disc thickness 48 according to the state of the art. Moreover, all of the blocking chamber walls 54, 56 and 58 are configured with their inner surfaces to be smooth or unribbed.

As a whole according to FIG. 2, a substantially smaller spacing between the blocking disc 94 and the blocking chamber walls 54, 56 and 58 is created as compared to the state of the art. This allows less blocking fluid volume to be required for filling the blocking chamber 44 according to FIG. 2 than for filling the blocking chamber 44 according to FIG. 1. Moreover, in case of less blocking fluid volume, less turbulences occur in the blocking fluid when the blocking chamber 44 is rotating. It has been shown surprisingly that this smaller blocking fluid volume is sufficient for the desired reliably blocking action with respect to ambient air.

Furthermore, the gripper chamber 70 according to FIG. 2 features radial grooves as ribbings 72 only on its radial gripper chamber wall 64. However, the axial gripper chamber wall 68 is smooth on its inner surface.

Finally, it should be noted that the entirety of features mentioned in the application documents and in particular in the dependent claims should also be protected individually or in any combination despite of the formal back reference made to one or more certain claims.

LIST OF REFERENCE NUMERALS

10 separator
12 drum housing
14 blocking device
16 rotational axis
18 inlet device
20 inlet nozzle
22 inlet tube
24 outlet device
26 outlet tube
28 common axial channel portion
30 gripper
32 inlet channel
34 interior of the drum
36 gripper channel or discharge channel
38 outlet channel
40 outlet nozzle
42 fixed tube device
43 inside end area
44 blocking chamber
46 blocking disc
48 mean disc thickness
50 blocking fluid nozzle
52 blocking fluid channel
54 axial blocking chamber wall
56 upper radial blocking chamber wall
58 lower radial blocking chamber wall
60 ribbing
62 blocking chamber overflow edge
64 radial gripper chamber wall
66 drum overflow edge
68 axial gripper chamber wall
70 gripper chamber
72 ribbing
74 cap
75 fastening tube
76 oblique outer wall section
78 hollow cylindrical outer wall section
80 interior or cavity of the cap
82 drum ring being L-shaped in its cross section
84 upper ring edge or overflow edge
86 lower ring edge
88 interior or cavity of the drum ring
90 web ring
92 upper ring area
94 blocking disc
96 disc thickness

The invention claimed is:

1. An outlet device (24) of a separator (10), the outlet device (24) comprising an outlet channel (38) for discharging a liquid phase from a rotating drum of the separator (10), wherein the outlet channel (38) extends along a rotational axis (16) in a fixed tube device (42) of the separator (10), the outlet device further comprising:

a cap (74) that is provided within a drum housing (12) of the separator (10), the cap (74) being connected fixedly to the tube device (42), surrounds the tube device (42) and covers the drum in a radial direction;

a drum ring (82) arranged in an interior (80) of the cap (74), the drum ring (82) being connectedly fixedly to the drum and being L-shaped in cross-section;

a web ring (90) arranged in an interior of the drum ring (82), the web ring (90) being connected fixedly to the tube device (42) and extending radially to the outside;

a gripper (30) supported on the tube device (42);

a blocking disc (94) projecting radially out from the tube device (42);

an axial blocking chamber wall (54) projecting axially from the drum and being radially outward from the blocking disc (94); and an upper radial blocking chamber wall (56) projecting radially inward from the axial blocking chamber wall (54) and being spaced axially from the blocking disc (94), the drum ring (82) projecting from a radially inner part of the upper radial blocking chamber wall (56).

2. The outlet device according to claim 1, wherein the cap (74) covers the drum in the radial direction and also in the axial direction.

3. The outlet device according to claim-5 1, wherein the gripper (30) is surrounded by a gripper chamber (70), the gripper chamber (70) being defined by one radial gripper chamber wall (64) and one axial gripper chamber wall (68), each defining part of the drum, the radial gripper chamber wall (64) being provided with a ribbing (72) and the axial gripper chamber wall (68) having no ribbing.

4. The outlet device according to claim 1, wherein the blocking disc (94) is axially between the cap (74) and the gripper (30), the blocking disc (94) being fixedly connected to the tube device (42) and being surrounded by a blocking chamber (44) delimited by the axial blocking chamber wall (54), the upper radial blocking chamber wall (56) and a lower radial blocking chamber wall (58) disposed on a side of the blocking disc (94) opposite the upper radial blocking chamber wall (56).

5. The outlet device according to claim 4, wherein the blocking disc (94) is configured to have a constant disc thickness (96) in the axial direction.

6. The outlet device according to claim 1, wherein an inlet device (18) is formed in the interior of the outlet device (24) for admitting a phase mixture to the drum of the separator (10).

7. The outlet device according to claim 1 wherein the drum ring (82) includes an axial extension projecting axially from the radially inner part of the radial blocking chamber wall (56) in a direction away from the blocking disc (94) and a radial extension projecting radially in so that the web ring (90) is between the radial extension of the drum ring (82) and the blocking disc (94).

8. The outlet device according to claim 7, wherein the fixed tube device (42) includes an annular recess in an outer circumferential surface thereof, the radial extension of the drum ring (82) defining an upper ring edge (84) projecting into the annular recess in the outer circumferential surface of the fixed tube device (42).

9. The outlet device according to claim 8, wherein the drum ring (82) includes a lower ring edge (86) at a position radially outward from the web ring (90) and at a position closer to the blocking disc (94) than a position of the web ring (90) relative to the blocking disc (94).

* * * * *